US005979198A

United States Patent [19]

Haas-Tröber et al.

[11] Patent Number: 5,979,198

[45] Date of Patent: Nov. 9, 1999

[54] LOCKING MECHANISM WITH EMERGENCY OPENING FEATURE USEFUL FOR A SAFE OR VAULT

[75] Inventors: Michael Haas-Tröber, Beverly Mai, Singapore; Michael Kohne, Waldkirch, Germany

[73] Assignee: Sphinx Elektronik GmbH, Waldkirch, Germany

[21] Appl. No.: 09/135,343

[22] Filed: Aug. 17, 1998

[30] Foreign Application Priority Data

Sep. 4, 1997 [DE] Germany ..... 197 38 748

[51] Int. Cl.[6] ..... E05B 43/00

[52] U.S. Cl. ..... 70/268; 70/279.1

[58] Field of Search ..... 70/268, 267, 269, 70/270, 271, 272, 273, 274, 279.1

[56] References Cited

U.S. PATENT DOCUMENTS

| | | | |
|---|---|---|---|
| 1,813,441 | 7/1931 | Diesel | 70/270 |
| 2,145,314 | 1/1939 | Murtaugh, Jr. | 70/269 |
| 3,835,679 | 9/1974 | Heinemann et al. | 70/273 |
| 3,881,171 | 4/1975 | Moorman et al. | 70/271 |
| 4,062,210 | 12/1977 | Uyeda | 70/268 |
| 4,593,545 | 6/1986 | Terry et al. | 70/269 |
| 4,649,833 | 3/1987 | Cummins | 70/268 |
| 4,763,937 | 8/1988 | Sittnick, Jr. et al. | 292/92 |
| 4,843,850 | 7/1989 | McGregor | 70/272 |
| 4,982,585 | 1/1991 | Davis et al. | 70/269 |
| 5,339,662 | 8/1994 | Goldman | 70/278 |
| 5,404,737 | 4/1995 | Hotzl | 70/279.1 |

FOREIGN PATENT DOCUMENTS

| | | | |
|---|---|---|---|
| 35979 | 9/1981 | European Pat. Off. | 70/279.1 |
| 91314 | 10/1983 | European Pat. Off. | 70/268 |
| 0402537 | 12/1990 | European Pat. Off. | 70/268 |
| 2549519 | 1/1985 | France | 70/268 |
| 3447142 | 4/1986 | Germany | 70/279.1 |
| 1561723 | 2/1980 | United Kingdom | 70/268 |

*Primary Examiner*—Suzanne Dino Barrett
*Attorney, Agent, or Firm*—Henry M. Feiereisen

[57] ABSTRACT

A locking mechanism of the key lock type or code lock type for installation in a door of a vault or safe, includes at least one locking bolt for movement between a locking position in which a door is locked and an unlocking position in which the door is released for opening, an electromechanical actuator connected to the locking bolt for moving the locking bolt between the locking position and the unlocking position, a time delay circuit so interacting with the actuator as to delay operation of the actuator for a specified time period, with the time delay circuit being so positioned as to be inaccessible upon closed door and including an activation input for cooperation with a switch accessible from outside such that the time delay circuit is activated.

18 Claims, 2 Drawing Sheets

LOCKING MECHANISM WITH EMERGENCY OPENING FEATURE USEFUL FOR A SAFE OR VAULT

BACKGROUND OF THE INVENTION

The present invention generally refers to a locking mechanism useful for the door of a safe or a vault, and in particular to a locking mechanism of a type having at least one key-type lock or combination-type lock which in unlocked position releases at least one locking bolt.

Common to all type of locking mechanisms, hereinafter called "lock" for short, of any type and construction, is the problem associated with loss or forgetting the key to open a locked door. Regardless as to whether a mechanical key or an electronic key or a type of lock that operates on the basis of a numerical combination or code are involved, assistance of a third party is normally needed for opening the lock, either with the help of a master key or with a spare key or, in a worst case scenario, by force that leads to damage or destruction of the structure. The use of force to open the lock becomes especially unavoidable in those situations in which for security reasons the production of a master key or spare key is not permitted, or in which for reasons of time constraint a master key or spare key can not be made available in due time.

SUMMARY OF THE INVENTION

It is thus an object of the present invention to provide an improved locking mechanism, obviating the afore-stated drawbacks.

In particular, it is an object of the present invention to provide an improved locking mechanism which can be unlocked undamaged even in situations when a spare key or a master key is lost, without requiring the use of force.

These objects, and others which will become apparent hereinafter, are attained in accordance with the present invention by providing a time delay circuit which so interacts with an electromechanical actuator for moving the locking bolt assembly between the locking position and the unlocking position, as to delay operation of the actuator for a predetermined time period, with the time delay circuit being so positioned as to be inaccessible when the door is closed and including an activation input for cooperation with a switch accessible from outside such that the time delay circuit is activated for delaying operation of the actuator for the selected time period.

The present invention is based on the teaching to provide a locking mechanism equipped with an emergency opening function that can easily be triggered at any time but delays the release of the locked position after a predetermined waiting period as selected by the authorized user to best suit to respective conditions. A choice of the appropriate time delay ensures that an unauthorized person, even when having knowledge about the emergency opening function, is prevented from accessing the safe or vault because the unauthorized person has no knowledge about the duration of the waiting period. In that respect, the locking mechanism according to the present invention differs from so-called time locks used in high security containers such as e.g. vaults of banks. The function of such time locks is based on allowing a release of the locking bolt or other locking mechanism at a preset time, e.g. within normal business hours of a bank, even when using the proper key, either by an authorized person or unauthorized person who has acquired the key.

When incorporating a locking mechanism according to the present invention within any of the known mechanical locks, the mechanical actuators for the locking bolt interact with a coupling device which interrupts the kinematic chain of action between the mechanical actuators and the locking bolt either when the electromechanical actuator responds or, optionally, when the time delay circuit is activated. In the event the locking mechanism according to the present invention is used for an electromechanical lock, the already existing electromechanical actuator is used for actuating the locking bolt so that it is only necessary to modify the actuator in a way as to be responsive to the time delay circuit.

Preferably, the switch located outside of the secured space and provided to trigger the emergency opening function through activation of the time delay circuit is a push button operated switch which may be located in an area where the key to the lock is inserted or where an opening code is inputted on a key pad. Suitably, the switch is placed in an area that is not immediately visible from outside so as to increase the safety aspect. In particular, the switch may be recessed so as to be actuatable only via a small and inconspicuous aperture, optionally by insertion of a pin or special tool. Persons skilled in the art will understand that the switch communicating with the activation input of the time delay circuit may certainly also be placed separate from the locking mechanism e.g. in a central monitoring room. This would be practicable e.g. in connection with lockers or safe deposit boxes, whereby the line connecting the time delay circuit to the switch may then be guided and masked invisibly from outside.

Suitably, the time delay of the time delay circuit may be set by adjusting elements that are inaccessible when the door is closed. Alternatively, or in addition, the time delay may fluctuate within optionally adjustable limits in accordance with a random process. An unauthorized person, triggering the emergency opening lock, is thus not in a position to predict when the locking mechanism will be activated for release of the locking bolt.

According to another feature of the present invention, the time delay circuit is so designed as to receive a reset impulse when the lock is released, e.g. by a key or inputted code, to open the door. This is advantageous in situations when a relatively long time delay is selected and set because there is no necessity to wait for the end of the time delay period, in the event the physical key is found or the user remembers the key code.

Suitably, at least the actuator and the time delay circuit can be battery-powered. This is especially advantageous for safe deposit boxes in hotel rooms which for the most part already run on batteries for saving wire installations. However, it is certainly within the scope of the present invention to provide an external power supply for at least the electromechanical actuator and the time delay circuit, as alternative or in addition to the battery-operated power supply. Thus, when the entire locking mechanism runs on batteries, the emergency opening function is maintained even though the batteries, that are typically inaccessible from outside, become exhausted.

According to another feature of the present invention, the switch is operatively connected to an acoustic or visual signaling device which is triggered upon activation of the switch. In this manner, the safety aspect against unauthorized use is enhanced. The signaling device can be designed in a tamper-proof manner, especially when used directly with the locking mechanism. In a simple case, the signal may be constituted by a light emitting diode integrated in the door. If the switch is already located in the door and thus directly associated to the locking mechanism, the light emitting diode may be incorporated in the switch. In some applications, such as spaces with numerous lockers or safe deposit boxes, it may be suitable to install the signaling device or, optionally, a second signaling device connected in parallel, in a central surveillance room from where it can then be determined whether or not the emergency opening function is triggered by an authorized person.

As a consequence of its relatively simple structure, the emergency opening mechanism according to the present invention can easily be integrated subsequently in a conventional locking mechanism for vaults or safes. Then, at least the switch and the time delay circuit are designed as retrofit kit.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
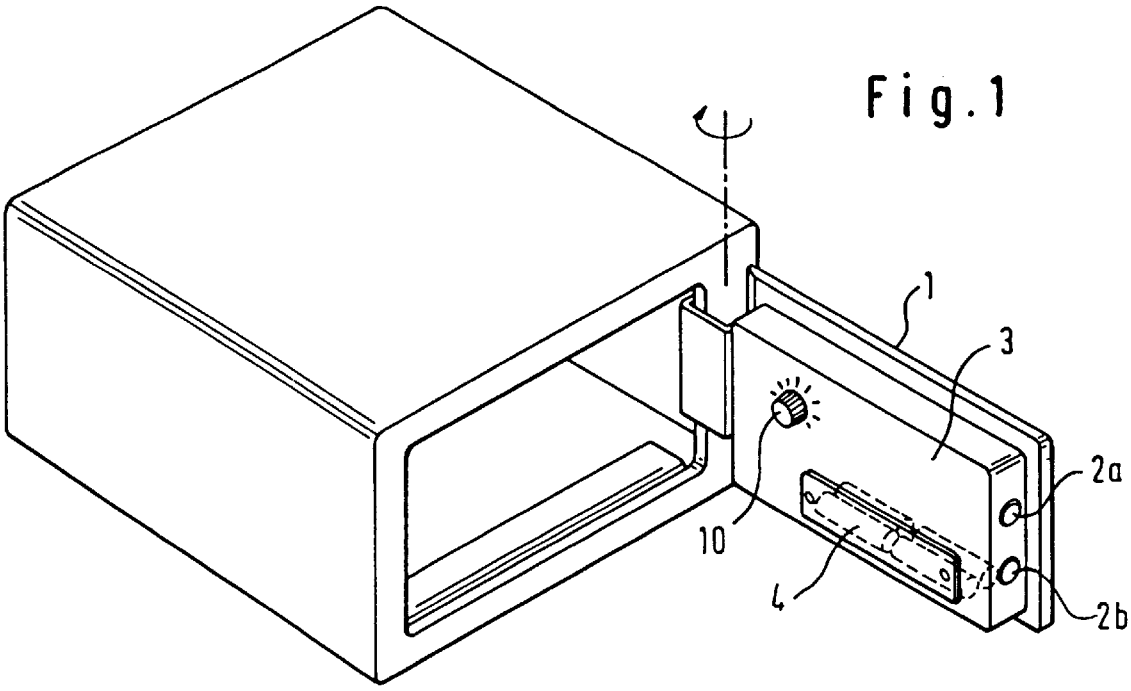
FIG. 1 shows by way of example a safe deposit box typically used in a hotel room, with the door in open position and equipped with a locking mechanism according to the present invention.

Throughout all the Figures, same or corresponding elements are generally indicated by same reference numerals.

Turning now to the drawing, and in particular to FIG. 1, there is shown by way of example a safe deposit box typically used in a hotel room, equipped with a locking mechanism according to the present invention. The safe deposit box has a door 1 which has incorporated therein a conventional electromechanical lock that includes two locking bolts 2*a*, 2*b* in superimposed spaced-apart parallel disposition. The locking bolts 2*a*, 2*b* are actuated in unison in a conventional manner by an electromechanical actuator 20 (see FIG. 4) e.g. in the form of an electromotor followed by a suitable gearing. The electromotor is controlled by a control circuit 21 and is encased by a housing 3 secured to the inside of the door 1. Electric energy is supplied to the electromotor and associated control circuit 21 by four batteries retained in a battery bay 4, as shown in FIG. 1 by broken lines.

Figure 3:
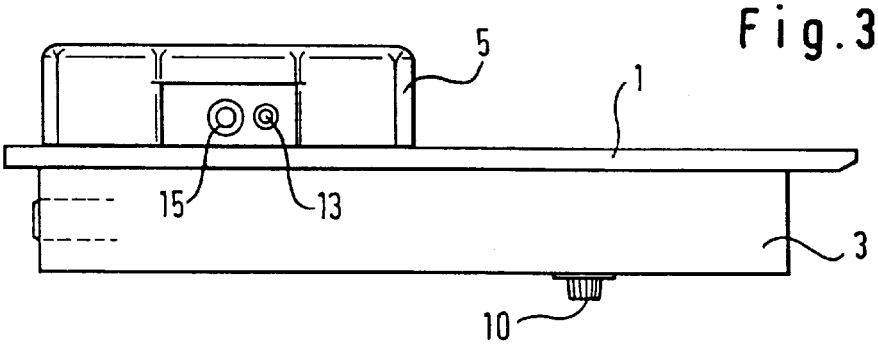
FIG. 3 is a bottom view of the door, as viewed in direction of arrow III in FIG. 2.
Figure 2:
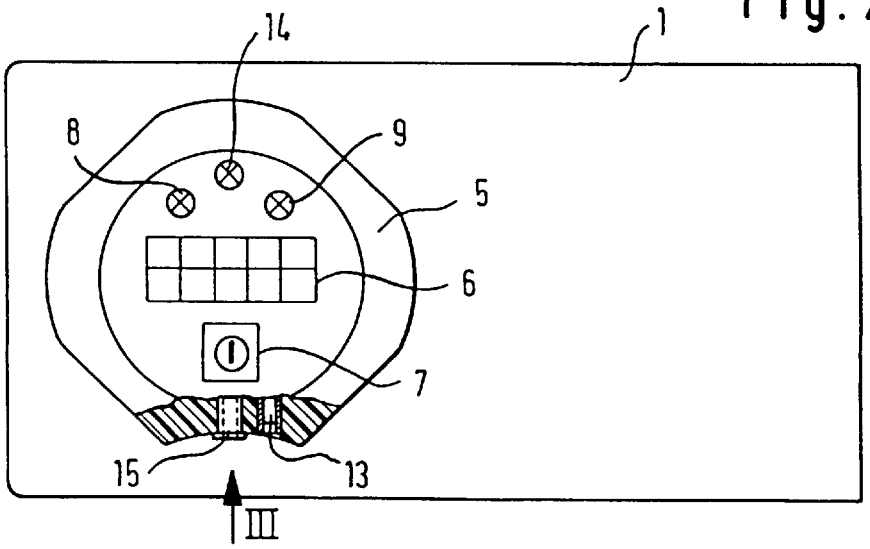
FIG. 2 is a top view of the door of the safe deposit box of FIG. 1.

The control circuit 21 is operatively connected to a control panel located on the outside of the door 1. As shown in FIGS. 2 and 3, the control panel includes a casing 5 made of suitable plastic material and secured to the door 1. On the outside of the casing 5 is a key pad 6 for inputting numbers 0 to 9. Through inputting the proper combination of numbers forming the key code and actuation of a confirmation or enter key 7, a user may unlock and access the safe deposit box. The control panel further includes a light emitting diode (LED) 8, e.g. green, for indicating the position "locked" and a light emitting diode (LED) 9, e.g. red, for indicating the position "unlocked".

Figure 4:
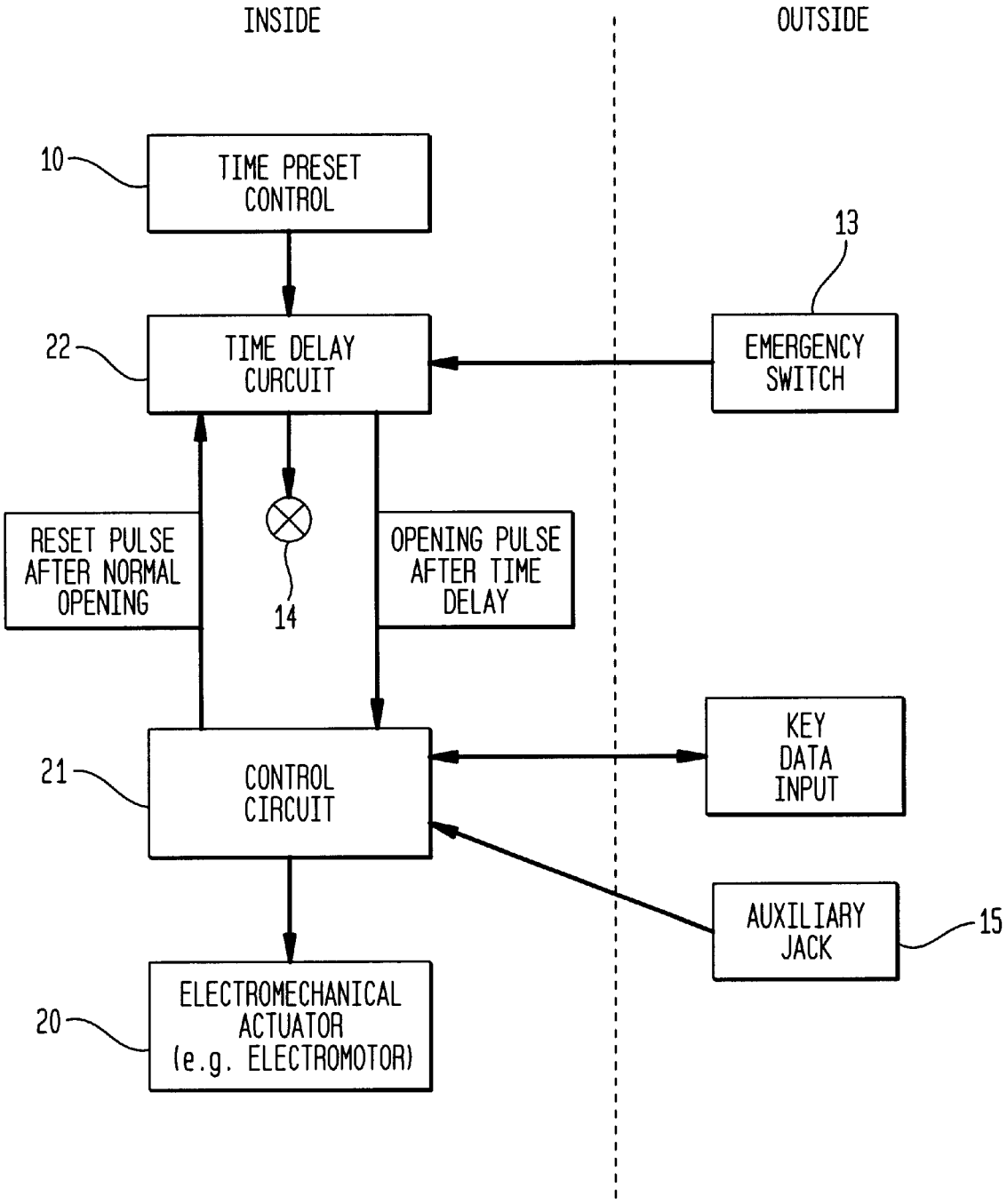
FIG. 4 is a schematic block diagram showing various non-mechanical parts for effecting an emergency opening function of the locking mechanism according to the invention.

Incorporated inside the door 1 in addition to the control circuit 21 is an emergency opening device in the form of a time delay circuit 22 which, as shown in FIG. 4, has an output operatively connected via the control circuit 21 to the electromotor which operates the locking bolts 2*a*, 2*b*. A time delay preset knob 10 is located at the inside of the door 1 and permits selection of a time delay period e.g. from several minutes to several hours through adjustment of e.g. a potentiometer forming part of the time delay circuit 22. Activation of the time delay circuit 22 is effected via a push button operated switch 13 which is located hidden from view on the underside of the casing 5 (FIG. 3) and triggered through insertion of a key or pin or the like tool.

When the switch 13 is actuated, a steady or blinking light of a signaling mechanism, e.g. in the form of a third light emitting diode (LED) 14 gives indication of the actuation. After elapse of the set time delay period, the time delay circuit 22 outputs a signal to the control circuit 21 which in turn activates the electromotor for retracting the locking bolts 2*a*, 2*b* from their locked position into an unlocked position to permit opening of the door 1. In order to insure a withdrawal of the locking bolts 2*a*, 2*b* even when the batteries are exhausted, the locking mechanism has an auxiliary jack 15 next to the switch 13 for connection of an external power supply.

If after activation of the emergency opening device via the push button switch 13, the correct code, i.e. number code selected for this particular lock, is inputted via the key pad 6, the time delay circuit 22 will be reset by a signal inputted by the control circuit 21. At the same time, the control circuit 21 triggers in its normal functioning mode a withdrawal of the locking bolts 2*a*, 2*b*.

It is noted that the foregoing description generally refers to a time delay circuit without illustrating a particular example because such time delay circuits are generally known to persons skilled in the art. Also, the artisan has a wide variety of commercially available integrated circuits like e.g. NE 555 from e.g. Texas Instruments or SGS Thomson at his or her disposal to form time delay circuits that best suit the situation at hand so that a detailed description of such a time delay circuit has been omitted for sake of simplicity.

However, typically, electromechanical locks contain frequently a microcontroller or microprocessor which is programmable to perform a variety of functions, including the function of the time delay circuit and other control functions. Additional functions can also be programmed. For example, the control logic can be so dimensioned as to maintain activation of the LED 14 for signaling use of the emergency opening function until a particular clear signal is inputted. Alternatively or in addition, the locking mechanism may be so programmed as to permit use of the particular key for the switch 13 and number code for only one time but would bar any further use. Also, the use of the third LED 14 for indicating triggering of the emergency opening function may be substituted by other signaling mechanism, e.g. by simultaneous blinking of LED 8 and LED 9.

Persons skilled in the art will also understand that the application of a time delay circuit according to the present invention may also be provided in other type of locks, differing from the non-limiting example as shown in FIGS. 2 and 3. For example, locks are known which use an electronic key, e.g. in form of a plastics card which contains a so-called transponder. An electronic lock of this type is provided with a transponder reading unit that is housed within the casing 5 and is able to output a coded radio signal of slight range. The transponder of the electronic key receives this signal to convert it into a coded response signal which is then received by the reading unit and decoded. Certainly, an electronic lock of this type may also be modified to include a time delay circuit to enable opening of the safe deposit box or other container when the electronic key is lost in a manner described above.

While the invention has been illustrated and described as embodied in a locking mechanism with emergency opening feature for use with a safe or vault it is not intended to be limited to only those safety locks but can be used in any other situation where a safety locking function may be desired and various modifications and structural changes may be made without departing in any way from the spirit of the present invention.

What is claimed as new and desired to be protected by Letters Patent is set forth in the appended claims:

What is claimed is:

1. A locking mechanism of the key lock type or code lock type for installation in a door of a vault or safe, comprising:

at least one locking bolt for movement between a locking position in which a door is locked and an unlocking position in which the door is released for opening;

an electromechanical actuator connected to said at least one locking bolt for moving the locking bolt between the locking position and the unlocking position;

a first opening mechanism initiated by insertion of a key or input of a code to operate the actuator; and a second opening mechanism for operating the actuator when the key or the code is not available, said second opening mechanism including a time delay circuit so interacting with the actuator as to delay operation of the actuator for a specified time period, said time delay circuit being so positioned as to be inaccessible upon closed door and including an activation input, and a switch accessible from outside and communicating with the input to enable activation of the time delay circuit.

2. The locking mechanism of claim 1 wherein the time delay circuit includes an adjustment element inaccessible upon closed door and enabling a setting of the period of time delay.

3. The locking mechanism of claim 1 wherein the period of time delay is selected randomly, optionally within set limits.

4. The locking mechanism of claim 1 wherein the time delay circuit is so dimensioned as to receive a reset signal when the locking bolt moves to the unlocked position.

5. The locking mechanism of claim 1, and further comprising a battery-operated power supply for supply of electric energy to at least the actuator and the time delay circuit.

6. The locking mechanism of claim 4, and further comprising a jack for connection of an external power supply for supply of electric energy to at least the actuator and the time delay circuit.

7. The locking mechanism of claim 1, and further comprising a signaling device so interacting with the switch as to trigger a signal when the switch is actuated.

8. The locking mechanism of claim 7 wherein the signaling device triggers an acoustic signal.

9. The locking mechanism of claim 7 wherein the signaling device triggers a visual signal.

10. The locking mechanism of claim 6 wherein the signaling device is a light emitting diode integrated in the door.

11. The locking mechanism of claim 10 wherein the light-emitting diode is integrated in the switch.

12. The locking mechanism of claim 1 for use in a vault of a type having an electronic code-type lock device, at least said switch and said time delay circuit being provided in the form of a retrofit kit.

13. A locking, comprising a first opening mechanism initiated by insertion of a kev or input of a code to open an access door to a locked space; and a second emergency opening mechanism for allowing access to the locked space when the key or the code is not available, said emergency opening mechanism including a time delay circuit having separate activation input actuatable from outside the locked space, said time delay circuit being so programmed as to delay opening of the access door to the locked space by a preset time period randomly selectable by an authorized user or a program upon actuation of the activation input.

14. The locking device of claim 13 wherein the time delay circuit includes a timer for setting the period of time delay, said time being inaccessible upon locked space.

15. The locking device of claim 14 wherein the time delay circuit is so dimensioned as to receive a reset signal when gaining access to the locked space.

16. The locking device of claim 14, and further comprising a signaling device so interacting with the time delay circuit as to trigger a signal when the time delay circuit is activated.

17. The locking device of claim 16 wherein the signaling device triggers an acoustic signal.

18. The locking device of claim 16 wherein the signaling device triggers a visual signal.

* * * * *